United States Patent [19]

Danielsson

[11] 4,281,496

[45] Aug. 4, 1981

[54] METHOD OF FORMING CONCRETE FLOORS AND PRODUCT OF THE METHOD

[76] Inventor: Jan O. Danielsson, 50 Almenar Dr., Greenbrae, Calif. 94904

[21] Appl. No.: 55,174

[22] Filed: Jul. 6, 1979

[51] Int. Cl.[3] ..... E04B 5/32

[52] U.S. Cl. ..... 52/612; 264/31; 264/69; 264/162

[58] Field of Search ..... 264/31, 162, 69; 51/283 R; 125/3, 4; 52/612

[56] References Cited

U.S. PATENT DOCUMENTS

| | | | |
|---|---|---|---|
| 2,078,289 | 4/1937 | Sloan | 264/31 |
| 2,280,333 | 4/1942 | Williams | 264/31 |
| 2,289,248 | 7/1942 | Davis | 264/31 |
| 2,685,236 | 8/1954 | Wisniewski | 264/31 |

OTHER PUBLICATIONS

Design and Control of Concrete Mixtures, 9th Ed., Portland Cement Association, Chicago, Illinois, 1948, pp. 43–45.

*Primary Examiner*—Thomas P. Pavelko

*Attorney, Agent, or Firm*—Fitch, Even, Tabin, Flannery & Welsh

[57] ABSTRACT

A method for forming a concrete floor as a monolithic unit is disclosed wherein wet concrete mix is deposited and screeded to achieve a generally uniform thickness of concrete with the aggregate being densified or settled to produce a thin upper layer formed substantially from sand and cement, thereafter floating the concrete to substantially remove surface irregularities, and then grinding the upper surface of the concrete floor after it is hardened to produce a flat surface having a "sanded" finish.

13 Claims, 6 Drawing Figures

FIG. 1 (PRIOR ART)
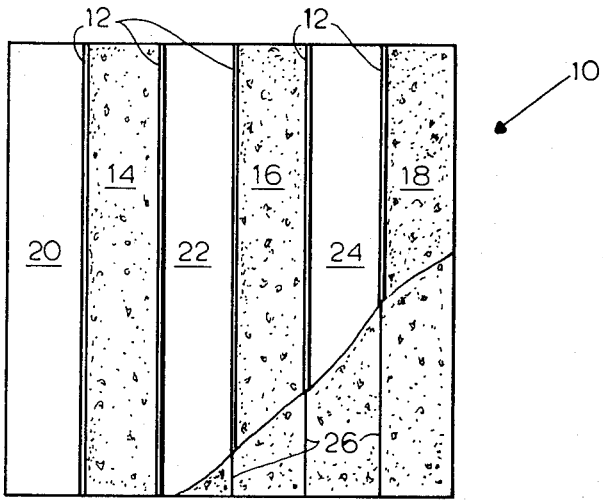
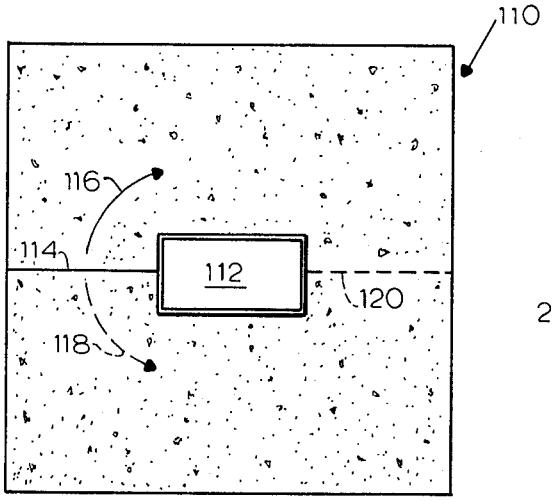
FIG. 2
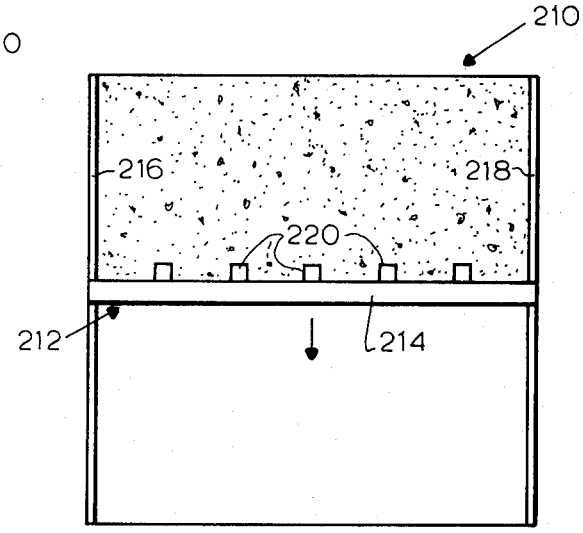
FIG. 3
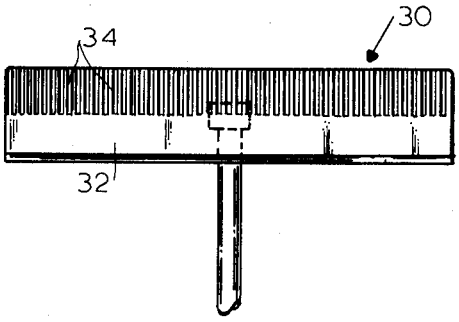
FIG. 4
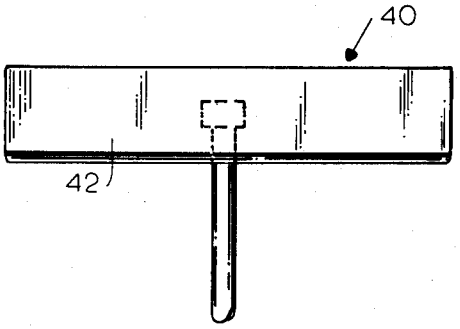
FIG. 5

METHOD OF FORMING CONCRETE FLOORS AND PRODUCT OF THE METHOD

The present invention relates to a method for forming concrete floors and more particularly to such a method employed for forming concrete floors upon a suspended substrate in high-rise buildings.

In the prior art, a wide variety of techniques, methods and apparatus have been employed for forming concrete structures and particularly for forming concrete floors. Of these many techniques, two are described below in detail in order to contrast and demonstrate the novelty and unexpected utility of the present invention. These two techniques include a method of forming floors as occasionally practiced in Europe with a final step of grinding the surface of the floor to produce a flat surface and a technique commonly practiced for example in the United States in forming concrete floors for high-rise buildings having structural steel skeletons and reinforced substrates for supporting the concrete floor.

In the European technique first mentioned above, the concrete is deposited upon a supporting structure of removable forms with reinforcing steel or the like being placed directly in the concrete medium. According to this technique, the concrete is generally deposited in substantial thicknesses of six to twelve inches, for example, and contains reinforcing steel or the like for forming a structural element after removal of the forms. According to this technique, wet concrete mix is deposited upon the forms and a rough leveling or screeding operation is accomplished by means of a heavy vibrating screed which is generally necessary in order to assure densification or compaction of the concrete throughout its substantial depth and to assure integral contact between the concrete and the reinforcing steel. Because of the need for a relatively heavy vibrating screed, this technique requires supporting forms which establish the upper surface of the floor and support the ends of the vibrating screed. The forms are normally placed up to about five meters apart with the concrete being deposited therebetween and leveled by means of the vibrating screed. The concrete may be further smoothed by means of conventional float equipment immediately after the vibrating screed and then allowed to stand until "bleed water" has risen from the concrete to form shallow pools upon its upper surface. The concrete is allowed to stand until the bleed water has substantially risen to its surface. As the bleed water rises through the concrete, it tends to produce some disruption in the surface continuity of the concrete. Accordingly, a second floating operation is carried out after the bleed water has risen in order to form a smooth "creamy" surface layer upon the concrete including primarily cement and sand.

After this second floating operation, the concrete is then allowed to stand until it is hardened but not finally cured. The upper surface of the concrete is then particularly susceptible to being finished by means of a power tool such as a rotary grinder. Such a rotary grinder may for example include a rotating platform including means for replaceably mounting grinding stones upon its lower surface to contact or abrade the concrete and produce a flat "sanded" surface.

In practicing this conventional European technique, it will be apparent that a substantial amount of time elapses between the initial deposition of the concrete upon the floor and the final or second floating operation after which the concrete may be allowed to stand prior to its being finished in a grinding operation. More importantly, it is necessary to assure access of an operator to the surface of the concrete when the second floating operation is to be carried out. For these reasons, it has been common practice to form large floors in alternating strips, those strips being finished and allowed to harden so that the concrete surfaces are not susceptible to damage. On a subsequent day, the intermediate strips may then be formed in the same manner so that the final floor is formed with alternating strips having parallel joints extending throughout the floor. These joints are usually uneven and entail extensive finishing time, in addition to the time required for multiple forms. The finished floor may then be allowed to stand for a suitable period of time, for example, an additional 24 hours up to one week or even longer before the final grinding operation is accomplished. Within this time period, the concrete floor is sufficiently hardened to support the weight of the grinder without rupturing or tearing but not finally cured so that the grinding operation may be accomplished in a relatively efficient manner.

The "European" technique described in some detail above has not been employed in the construction of high-rise buildings for example in the United States for a number of reasons. In construction of high-rise buildings, the use of vibrating screeds is generally not feasible or economical. A suspended substrate normally provides a base upon which the concrete floor is formed. The substrate may become an integral portion of the floor along with a relatively thin layer of concrete, for example, approximately three to six inches. In addition, within such high-rise buildings, it has not been found satisfactory to provide forms of the type employed with the heavy vibrating screeds commonly used in the European technique. Accordingly, a substantially different technique is commonly employed for forming concrete floors in such high-rise buildings. That technique is described below and referred to generally as the "trowel" technique.

In conventional trowel technique described below, an entire floor or integral portion of a floor is commonly formed as a unit, without the use of intermediate forms or the like for controlling the height or thickness of the floor. According to this technique, the wet concrete mix is deposited upon the substrate which may be either a corrugated steel sheet or reinforced concrete for example. Thereafter, the concrete is first leveled in a rough operation commonly employing a manual screed. The thickness of the concrete is controlled by the operator who may employ occasional reference points with which he visually compares the height of the concrete being screeded.

The concrete floor is then floated shortly after it is poured and screeded. The floating operation may optionally include a first densifying step using a "jitterbug" or the like to prevent the occurrence of voids. Whether or not a densifying step is performed, the concrete is commonly smoothed by means of a flat floating tool such as a "bull float."

According to this technique, the concrete is then allowed to stand a suitable period of time, for example, approximately one-half to two hours, (four to six hours in cold, damp weather), during which time bleed water rises from the concrete and the concrete sets up sufficiently to support the weight of an operator. At that time, initial trowelling is performed either manually or with a power machine while the surface of the concrete may still be worked. The concrete is then trowelled a number of times as it dries to form a continuous, glazed surface which is substantially different from the "sanded" surface effect produced by a grinding operation such as that described above.

There have been found to be a number of disadvantages within the trowel technique described immediately above. Initially, the production of concrete floors is obviously labor intensive. Referring to the technique described above, it will be apparent that in order to allow the concrete to stand for a sufficient period of time prior to the final trowelling operation, it is necessary either to discontinue the pouring of concrete early during a work shift or to continue the final trowelling operation into an extended or second work shift. In either event, substantial additional costs are incurred which add significantly to the final cost of the floors and the overall cost of the building. Even further, because of the interruption of the pouring operation, substantial additional time of many days may be required for finishing the large number of floors in such a building. This time delay by itself can be a significant factor in the overall construction cost of the building because of the increased time before the building is ready for occupancy.

The trowel technique described above has been commonly employed at cnstruction sites in the United States. Power grinding has consistently been avoided in these operations because of the substantial cost for this operation alone. However, the present invention, as described in greater detail below, has produced the unexpected result of actually reducing overall costs for forming concrete floors through use of a method including power grinding as an essential step while eliminating all trowelling of the floor.

In any event, there was found to remain a need for a relatively efficient method for forming concrete floors in the construction of high-rise buildings and elsewhere while substantially decreasing the overall time for construction.

SUMMARY OF THE INVENTION

It is therefore an object of the present invention to provide a method for forming concrete floors wherein an entire floor or substantial floor portion is formed as a monolithic unit, the method including the steps of depositing wet concrete mix and roughly leveling the concrete by means of a screed and then floating the surface of the concrete to produce a generally flat surface, these combined steps being performed in a manner to effectively densify the concrete or to settle the aggregate in order to produce a thin upper layer which is formed substantially from sand and cement, the concrete then being allowed to stand for a period of at least approximately 24 hours or more after which the surface of the concrete is treated by means of a power grinder in order to remove a thin surface portion from the concrete and produce a flat "sanded" surface thereupon.

Within the context of the present invention, the term "monolithic" is employed to mean that the entire expanse of a floor, or a substantial portion of the floor which may be formed within a single working shift, is produced without joints of the type caused by the pouring or depositing of wet concrete adjacent concrete which has already set up. This condition tends to prevent formation of a completely integral bond with the freshly deposited concrete. As will be apparent from the following description, a joint of this type would be produced by the present invention for example if an entire floor is poured in a circular pattern having a common beginning and ending point. However, even within such a floor, its entire expanse between the beginning and ending points would be formed as a monolithic structure.

In forming such a floor according to the present invention, initial densification of settling of the aggregate may be accomplished in a number of ways. For example, the first floating operation may be accomplished with a corrugated or ribbed float such as a bull float, a vibrating bull float or other smooth float apparatus employed with a tamping action. All of these different techniques or tools accomplish the same effect of settling or densifying the aggregate within the concrete in order to produce a thin upper layer formed substantially from cement and sand which facilitates the final grinding step as discussed in greater detail below.

Densification or settling of the aggregate may also be accomplished by employing concrete having a relatively high water content. Although such a high water content may reduce final strength characteristics of the concrete, the additional water tends to cause the aggregate to settle within the concrete medium in order to accomplish densification as desired by the present invention.

It is also a further object of the invention to preferably employ a final floating operation in order to produce a generally flat surface upon the concrete before it is allowed to set up sufficiently for the final grinding operation and thereby minimize the amount of surface material removed from the concrete. In connection with this floating operation, it is important to note that the floor is continuously poured as a monolithic unit and portions of the floor rapidly become inaccessible to an operator unless the operator is upon the surface of the concrete itself. In the "European" technique described above, this presents a substantial problem solved by the formation of small areas or alternate strips as described above so that the operator could have access to all portions of the concrete in order to perform the floating operations when desired. According to the present invention, the final floating operation may be accomplished immediately after the concrete is first deposited, screeded and initially floated. In following such a technique, bleed water would subsequently rise from the concrete and be allowed to merely evaporate from the surface of the concrete as it sets up prior to the final grinding operation.

On the other hand, it has also been found that final floating may be carried out by means of a power tool such as a rotary float or the like after the bleed water has risen from the concrete provided that additional time elapses so that the concrete sets up sufficiently to support the weight of an operator. With the concrete being in this condition, the use of a heavy power float is necessary in order to adequately work the surface of the concrete in this condition.

It is also an object of the present invention to provide a variation of the method for forming concrete floors in applications permitting an entire dimension of the concrete floor to be spanned by a vibrating screed. Vibrating screeds of this type are commercially available with spans of over one hundred feet. Such a vibrating screed may be employed with the present invention when there are substantially no projections or obstructions throughout the expanse of the floor. Such floors may commonly be encountered in large shopping malls and other on-grade sites or even in the floors of multi-level buildings where elevator shafts, other service areas and the like are not in a central portion of the floor. Within such a combination, it is a relatively simple matter to provide forms along opposite sides of the floor so that the entire width of the floor may be poured and screeded simultaneously.

The vibrating screed accomplishes the basic function of densifying or settling aggregate in accordance with the present invention. Because of the substantial span for the vibrating screed, access to the entire wet concrete surface from an external point is not possible after the concrete is poured and screeded. Accordingly, the concrete is allowed to stand until bleed water has risen to the surface and the concrete is set up sufficiently to support the weight of an operator. At that time, the surface of the concrete is smoothed with a power float which is sufficiently heavy to permit working of the concrete surface. The floor is then allowed to stand for approximately 24 hours or more after which its surface is treated with a power grinder as described above in order to form a flat surface having a porous, sanded quality.

Many large concrete floors can be formed in a single pass through the use of such a vibrating screed. In some applications, however, the dimensions of the floor may be so great that a vibrating screed of the type described above will be incapable of spanning the entire floor. Accordingly, in these applications, the floor may be formed in multiple segments, each segment being produced in the same manner as described above to produce a monolithic unit.

The methods described above thus contemplate formation of concrete floors in multi-level buildings and even in on-grade applications such as large floors for shopping centers. The present invention may also be employed where the concrete floor is formed upon a reinforcing substrate of metal or preformed concrete which becomes an integral portion of the floor. Even in these applications, some reinforcing metal is often disposed within the poured slab of concrete. In addition, the method or methods of the present invention may also be used where the concrete is poured upon removable forms and reinforcing metal or material is placed within the concrete. In these applications, the removable forms are of course removed after the concrete and self-contained reinforcing material provide sufficient strength for supporting the weight of the floor.

It is also an object of the present invention to provide a concrete floor as a product of the method or methods described above, the floor being further characterized as a monolithic structure and having a surface which is flat, porous and of a "sanded" character. Such surface characteristics are particularly desirable for the application of tile, carpeting or the like upon the finished floor.

Additional objects and advantages of the invention are made apparent in the following description having reference to the accompanying drawings.

BRIEF DESCRIPTION OF THE DRAWINGS

FIG. 1 is a representation of one prior art method by which concrete floors have been commonly formed.

FIG. 2 is a similar view representing the method by which concrete floors are formed according to the present invention.

FIG. 3 is yet another similar view of a concrete floor substantially free from obstructions or the like and permitting use of a vibrating screed spanning the entire floor in accordance with one preferred method of the present invention.

FIG. 4 is a view of a corrugated float of the type contemplated for use in the present invention.

FIG. 5 is a view of a smooth float as contemplated for use in the present invention.

DESCRIPTION OF THE PREFERRED EMBODIMENTS

Figure 6:
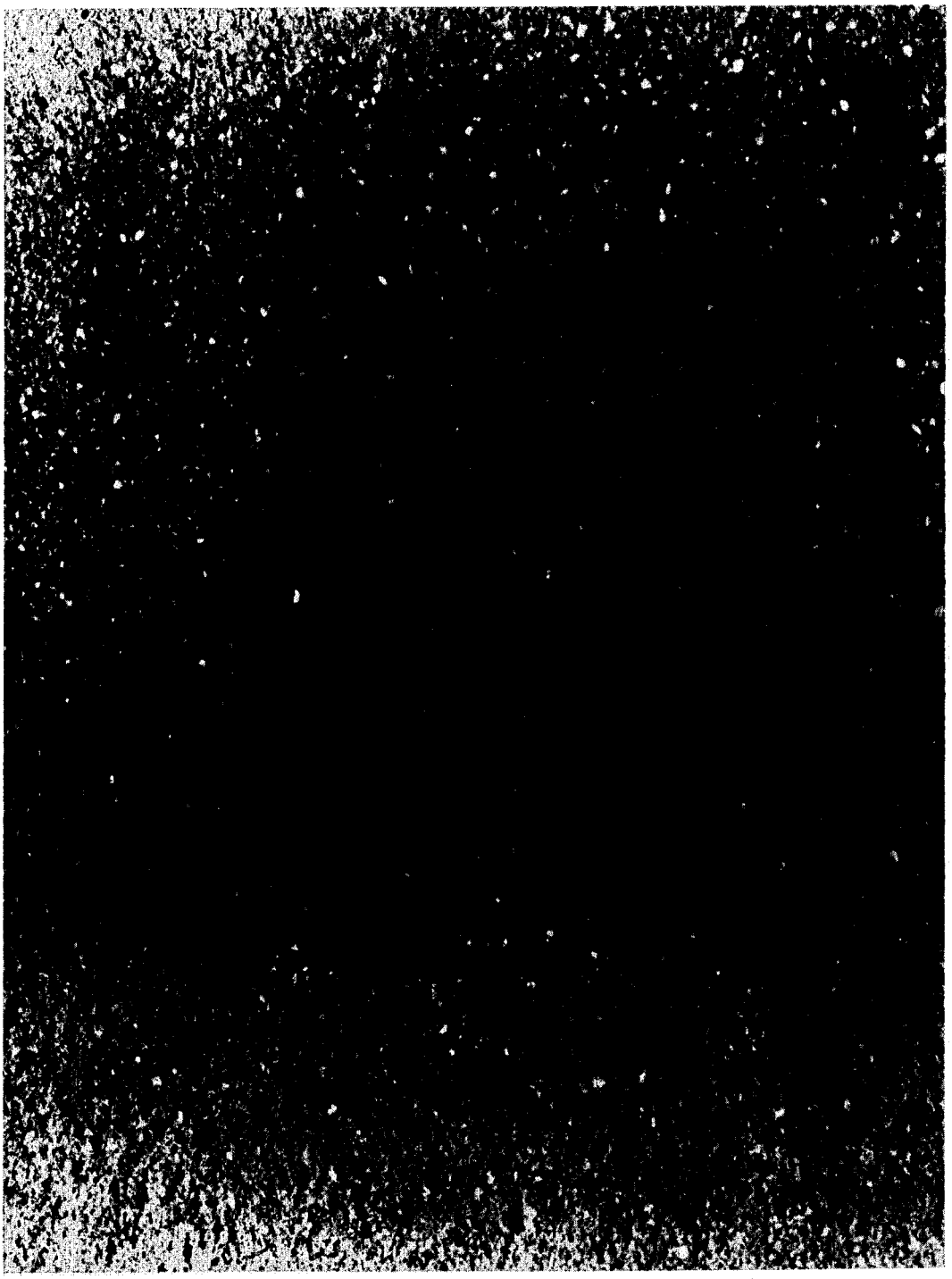
FIG. 6 is an enlarged photographic representation of a surface portion of a concrete floor formed in accordance with the present invention to illustrate its flat, porous and sanded characteristics.

The present invention contemplates an efficient and cost saving method for forming concrete floors wherein the floor is initially poured and rough leveled or screeded in a manner selected to densify or settle aggregate in the concrete to produce a thin upper layer formed substantially from fluid components of sand, cement and water. The concrete is then smoothed by a bull float or other similar smooth-surfaced float and allowed to stand at least aproximately 24 hours or more after which the surface of the concrete floor is treated with a power grinder in order to remove a portion of the concrete surface and produce a finished surface which is flat, porous and has a sanded characteristic.

In the following description, reference is first made to FIG. 1 in order to better define the "European" system discussed at some length above. One variation of the present invention is then described with reference to FIG. 2, the floor of FIG. 2 preferably being one level of a multi-level building wherein the floors are interrupted by service areas such as elevators and the like. For such an application, the present invention contemplates a method wherein a concrete slab is formed upon the floor as a monolithic unit, the method including a first step of depositing the concrete upon the floor and initially leveling the concrete by means of a manual screed, usually where the operator visually establishes the rough level of the floor.

Another variation of the invention is then described having reference to FIG. 3 showing a generally unobstructed floor and permitting the use of a vibrating screed extending entirely across one dimension of the floor. As will be described in greater detail below, this method involves initial rough leveling of the concrete with the vibrating screed. After the concrete sets up sufficiently to support the weight of an operator, the floor is then smoothed by means of a power float device and then allowed to stand 24 hours or more before being treated with a power grinder to produce a flat, porous surface having a sanded characteristic.

A floor of the type produced according to the present invention is illustrated in FIG. 6. FIGS. 4 and 5 are referred to below within the descriptions of the preferred methods as examples of apparatus which may be employed within the method of the present invention.

Referring now to the drawings, FIG. 1 is included in the drawings to assure a proper understanding of the European method referred to above. Assuming that the floor to be formed is about 30 meters square, for example, forms 12 may be arranged at 5-meter intervals across one dimension of the floor and extend the full length of the floor in the other direction.

Spaced-apart strips 14, 16 and 18 may be formed during a first work shift or day in accordance with the preceding description. It is to be particularly noted that operator access to the strips 14, 16 and 18 is provided throughout the entire operation by means of the alternate strips 20, 22 and 24. Such access is generally essential in the European technique. After the concrete in the spaced-apart strips 14, 16 and 18 is sufficiently hardened, the workers may return on another day to similarly pour the concrete floor in the alternate strips 20, 22 and 24. Since the concrete in the first strips 14, 16 and 18 is substantially set up before concrete is poured in the alternate spaces 20, 22 and 24, joints tend to remain as indicated at 26 between each adjacent pair of strips. Within this prior art technique, it will be obvious that the individual strips may be interrupted to allow for obstructions such as service areas in the floor 10.

Referring now to FIG. 2, one variation of a method for forming concrete floors according to the present invention is described immediately below having reference to FIG. 2 preferably representing one floor 110 of a multi-level building (not otherwise shown) wherein the floors are interrupted by a service area generally indicated at 112. Commonly, the floor 110 is formed by reinforcing material such as corrugated sheet metal or preformed concrete which becomes an integral portion of the floor including the concrete slab formed according to the present invention. However, as was noted above, the present invention may also be employed in applications where the floor is to be poured on fabricated forms which are removed after the floor, including self-contained reinforcement, attains sufficient strength to support its own weight.

According to the method of the present invention, concrete is poured upon the floor 110 and initially rough leveled or struck off by means of a conventional manual screed (not shown). With such a screed, the operator visually established the level of the floor by comparison with one or more reference points (also not shown).

Immediately after the concrete is screeded, it is initially treated in an additional step to densify or settle aggregate in order to produce a thin upper layer formed substantially from sand, cement and water. Preferably, this step involves the use of a corrugated float of the type illustrated in FIG. 4. Referring momentarily to FIG. 4, it may be seen that the float device 30 has a smooth surface 32 for engaging the upper surface of the concrete and a plurality of spaced apart corrugations or ribs 34 which project through the surface of the concrete to urge the aggregate downwardly into a densified or settled condition as described above. The corrugated float 30 of FIG. 4 is a preferred device for accomplishing this step. However, it will be apparent that the concrete may be similarly densified with other concrete tools such as a vibrating bull float or any of a number of smooth floats employed with a tamping action. After the concrete is deposited, screeded and densified as described above, the surface of the concrete is then smoothed by a conventional float operation. Preferably, this operation may be accomplished by means of a smooth float as illustrated at 40 in FIG. 5. The float 40 has a smooth uninterrupted surface 42 for engaging the surface of the concrete and producing a smooth surface. This step is desirable in order to minimize the amount of concrete to be removed during the subsequent grinding operation.

After the concrete is smoothed in accordance with the preceding step, it is then allowed to stand for a period of at least approximately 24 hours and up to one week or longer. Preferably, the concrete is allowed to stand for a period of approximately two to five days after which it is treated in a grinding operation as described immediately below. A conventional power grinder of the type contemplated by the present invention is illustrated in U.S. Pat. No. 3,098,329 issued July 23, 1963 and that reference is incorporated herein for the purpose of disclosing such a floor finishing machine. In any event, the power grinder is employed to remove a thin surface layer from the concrete floor and produce a flat, porous surface having a sanded quality as illustrated in FIG. 6.

The delay period prior to the grinding operation is selected to permit the concrete to set up so that it is not ruptured or "torn" by the grinder. At the same time, it is also desirable to accomplish the grinding operation before the concrete has completely cured since it then becomes difficult to remove a surface layer from the concrete. Accordingly, the grinding operation would be more inefficient if delayed until after complete curing of the concrete.

Referring again particularly to FIG. 2, the pattern in which the concrete is poured and treated may be selected according to the configuration of the floor. In FIG. 2, it may be seen that the floor is to be formed entirely around a central service area 112. With a single crew, it would of course be possible to begin pouring at a starting line 114 and continue around the entire periphery of the floor ending again at the line 114. Alternatively, the present invention also contemplates the use of multiple crews. For example, two finishing crews could begin in opposite directions as indicated by the solid arrow 116 and the broken line arrow 118. Both crews would then meet at an intermediate line 120. With the floor being formed according to this variation, it is immediately apparent that both crews would be simultaneously pouring wet concrete mix as they approach line 120 so that there would not be a joint formed at that point. Accordingly, with two such crews working, the entire slab for the floor 110 would be formed as a monolithic unit.

A number of variations are of course possible within the method described above having reference to FIG. 2. As noted above, the first step of the invention contemplates the depositions, screeding and densifying of the concrete, preferably by mechanical densification means. However, it is also possible to achieve densification through the use of a concrete mix provided with excess water tending to settle aggregate within the mix. Such a mix could result in relatively low strength characteristics for the finished concrete. However, if sufficient strength is provided for example by means of the reinforcing substrate, such a technique could also be employed for achieving densification.

As another variation of the technique described above in connection with FIG. 2, it is to be noted that the smooth manual float of FIG. 5 is preferably employed immediately after densification with the corrugated float 30 of FIG. 4 in order to produce a smooth surface upon the concrete. Within the scope of the present invention, it is also possible to use a power float of generally similar construction as the power grinder referred to above. Both of the devices are provided with a rotating platform adapted to mount grinding stones in the case of the power grinder or smooth float members in the case of a power float. With the final float operation being delayed until after the concrete develops sufficient strength to support the weight of an operator, the surface of the concrete is substantially more difficult to work because of its reduced plasticity.

Accordingly, a relatively heavy power float of the type described immediately above is employed to smooth the surface of the concrete. Thereafter, the concrete could again be allowed to stand in accordance with the preceding description before carrying out the final grinding operation.

Another variation of the present invention is described immediately below having reference to FIG. 3. FIG. 3 contemplates a floor 210 of large dimensions which is generally free from obstructions such as the service area 112 in the floor 110 of FIG. 2. In such an application, the present invention contemplates the use of a conventional vibrating screed 212 as is schematically illustrated at 212 in FIG. 3. The vibrating screed 212 has a strike-off bar 214 of sufficient length to span one dimension of the floor 210 so that it may be supported at its opposite ends by means of forms 216 and 218 extending the entire length of the floor 210. Vibrating means 220 are mounted on the strike-off bar. In this variation of the method according to the present invention, both rough leveling and densification are accomplished by means of the vibrating screed 212.

After the concrete sets up sufficiently to support the weight of an operator, a power float of the type described above is then employed to produce a flat or level surface after which the concrete is allowed to stand in accordance with the preceding description. Thereafter, the floor is treated with a power grinder also as described above in order to produce a flat, porous surface having a sanded characteristic as illustrated in FIG. 6.

Numerous modifications and variations in addition to those described above are of course obvious within the scope of the present invention which is accordingly defined only by the following appended claims.

What is claimed is:

1. In a method for forming a concrete floor, the steps comprising depositing wet concrete mix and roughly leveling the concrete and then floating the surface of the concrete to produce a more level surface, the step of depositing the concrete being performed according to a predetermined pattern selected to form the floor as substantially a monolithic unit, the combination of the steps of depositing, rough leveling and floating the concrete being selected in order to effectively densify the concrete and produce a thin upper layer formed substantially of water, sand and cement, allowing the concrete to stand for a period of at least approximately 24 hours and then removing a thin surface portion from the concrete with a grinder in order to produce a flat, porous surface having a sanded quality.

2. The method of claim 1 wherein the concrete is densified in a first float operation carried out after the concrete is deposited and rough leveled, the concrete thereafter being smooth floated prior to allowing the concrete to stand and then having a thin surface portion removed in a grinding operation.

3. The method of claim 2 wherein the first densification float step is performed with a corrugated bull float or the like in order to mechanically settle aggregate within the concrete.

4. The method of claim 3 wherein the second float operation is carried out by means of a smooth bull float.

5. The method of claim 2 wherein the first densification float step is performed with a smooth float operated with a tamping action to settle aggregate within the concrete.

6. The method of claim 5 wherein the second float operation is then performed with a smooth float device.

7. The method of claim 2 wherein the second float step is delayed until after bleed water has risen in the concrete and the concrete is sufficiently set up to support the weight of an operator, the second float operation then being carried out by means of a power float in order to permit working of the reduced plasticity concrete.

8. The method of claim 1 wherein the float operation is delayed until after bleed water has risen in the concrete and the concrete is sufficiently set up to support the weight of an operator, the second float operation then being carried out by means of a power float in order to permit working of the reduced plasticity concrete.

9. The method of claim 1 wherein densification is accomplished by adding excess water to the concrete prior to or at the time of deposition in order to settle aggregate within the concrete.

10. The method of claim 1 wherein the rough leveling operation is performed by means of an unsupported, manual screed wherein the rough level of the concrete is visually determined by an operator for the screed.

11. A concrete floor formed as a product of a process comprising the steps of depositing wet concrete mix and roughly leveling the concrete and then floating the surface of the concrete to produce a more level surface, the step of depositing the concrete being performed according to a predetermined pattern selected to form the floor substantially as a monolithic unit, the combination of the steps of depositing, rough leveling and floating the concrete being selected in order to effectively densify the concrete and produce a thin upper layer formed substantially of water, sand and cement, allowing the concrete to stand for a period of at least approximately 24 hours and then removing a thin surface portion from the concrete with a grinder, the concrete floor being further characterized by a flat, porous surface having a sanded quality.

12. In a method for forming a concrete floor in a large unobstructed area, the steps comprising simultaneously depositing, rough leveling and densifying wet concrete mix with a vibrating screed supported by forms extending along opposite sides of the floor area in order to produce an upper layer of wet concrete with a thin upper layer being formed substantially of water, sand and cement, the simultaneous step of depositing, rough leveling and densifying the concrete being continued across the entire expanse of the area in order to form the concrete floor as a monolithic unit, allowing the concrete to stand until bleed water has risen to the surface and the concrete is sufficiently set up to support the weight of an operator, then floating the surface of the concrete by means of a power float in order to permit working of concrete having reduced plasticity, allowing the concrete to stand for an additional period of at least approximately 24 hours and then removing a thin surface portion from the concrete with a grinder in order to produce a flat, porous surface having a sanded quality.

13. A concrete floor formed within an unobstructed area as a product of a process comprising the steps of simultaneously depositing, rough leveling and densifying wet concrete mix with a vibrating screed supported by forms extending along opposite sides of the floor area in order to produce a layer of wet concrete with a thin upper layer being formed substantially of water, sand and cement, the simultaneous steps of depositing, rough leveling and densifying the concrete being continued across the entire expanse of the area in order to form the concrete floor as a monolithic unit, allowing the concrete to stand until bleed water has risen to the surface and the concrete is sufficiently set up to support the weight of an operator, then floating the surface of the concrete by means of a power float in order to permit working of concrete with reduced plasticity, allowing the concrete to stand for an additional period of at least approximately 24 hours and then removing a thin surface portion from the concrete with a grinder, the finished concrete floor being characterized by a flat, porous surface having a sanded quality.

* * * * *